US006085985A

United States Patent [19]

LaSelva

[11] Patent Number: 6,085,985

[45] Date of Patent: Jul. 11, 2000

[54] SPLASH GUARD RADIATOR COVER

[76] Inventor: Ross LaSelva, 5 Farm View Rd., Bethel, Conn. 06801

[21] Appl. No.: 09/221,476

[22] Filed: Dec. 28, 1998

[51] Int. Cl.[7] ..... F24D 19/06

[52] U.S. Cl. ..... 237/79; 165/55

[58] Field of Search ..... 237/79; 165/53, 165/55, 135

[56] References Cited

U.S. PATENT DOCUMENTS

| | | | |
|---|---|---|---|
| 2,489,847 | 11/1949 | Arnold | 165/55 |
| 3,051,816 | 8/1962 | Knoll et al. . | |
| 3,141,499 | 7/1964 | Bunten | 165/55 |
| 3,768,549 | 10/1973 | Goodie | 165/55 |
| 4,157,731 | 6/1979 | Denhart | 165/55 |
| 4,250,954 | 2/1981 | Remlinger et al. | 165/1 |
| 4,383,575 | 5/1983 | Bobrowski | 165/55 |
| 5,454,512 | 10/1995 | Berlaimont et al. | 237/79 |
| 5,743,327 | 4/1998 | Villa | 165/55 |

*Primary Examiner*—Harold Joyce
*Assistant Examiner*—Derek S. Boles
*Attorney, Agent, or Firm*—Ourpal (R) Asija

[57] ABSTRACT

The splash guard radiator cover of this invention comprises an aluminum outer cover which does not rust, to protect the metal covers which do rust, on existing baseboard radiators, and to hide existing rust. Magnets are included for "Easy On Easy Off" operation. The purpose of this invention is to eliminate rust on baseboard radiators that are installed next to toilets or commodes. On many baseboard radiators, there are rust spots resulting from splashing of water and urine when the toilets are used especially when used by men in the standing position.

10 Claims, 8 Drawing Sheets

SPLASH GUARD RADIATOR COVER

BACKGROUND

This invention relates to baseboard radiators in the bath rooms near the toilet or commode. More particularly it relates to a splash guard radiator cover that prevents rust spots resulting from splashing of water and urine when the toilets are used especially by men in standing position.

THE PROBLEM

Baseboard radiators near the toilets are notorious for contracting rust due to splashing of water and urine when the toilets are used by men in the standing position. Even the most careful gentlemen cannot prevent microscopic splashing of urine unless they sit down, which they normally don't for reasons of male ego or some other unknown reasons. The urine being acidic begins to rust and corrode the radiator. The radiator cover of this invention solves this problem. Attempted radiator covers of the prior art fall short on effectiveness, elegance, simplicity, ease of installation, service & use and affordability.

SUMMARY

The splash guard radiator cover of this invention as the title implies comprises an aluminum outer cover which does not rust, to protect the metal covers which do rust, on existing baseboard radiators, and to hide existing rust. The purpose of this invention is to eliminate rust on baseboard radiators that are installed next to toilets. On many baseboard radiators, there are rust spots resulting from splashing of water and urine when the toilets are used. Especially when used by men in the standing position. Magnets are included for "easy On Easy Off" operation.

PRIOR ART

A preliminary prior art patentability and novelty search was conducted by Dr. Vance Israel of Accusearch in Baltimore Md.

Following are typical examples of the prior art uncovered arranged in the reverse chronological order for ready reference of the reader.

a) U.S. Pat. No. 5,743,327 awarded to Philip Villa of England on Apr. 28, 1998 for "Radiator System"

b) U.S. Design Pat. No. D-309,776 earned by Don Rudolph on Aug. 7, 1990 for "Wall Heater Cover"

c) U.S. Pat. No. 4,250,954 granted to Remlinger et al of Reading, Pa. on Feb 17, 1981 for "Heat Control Member and Method"

d) U.S. Pat. No. 4,157,731 bestowed upon Norbert Denhart of Cincinnati, Ohio on Jun. 12, 1979 for "Protective Housing for Strip Heaters"

e) U.S. Pat. No. 3,768,549 earned by Muriel Goodie of Toms River, N.J. on Oct. 30, 1973 for "Baseboard Electric Heater Shield"

f) British Utility Patent 1,031,576 published on Jun. 2, 1966 for "Improvements in Electric Hot Water Heating System"

g) U.S. Pat. No. 3,051,816 honorably issued to Knoll et al on Aug. 28, 1962 for "Baseboard Heater"

h) U.S. Pat. No. 2,489,847 honorably given to T. L. Arnold on Nov. 29, 1949 for "Radiator Cover"

i) U.S. Pat. No. 992,715 presented to C S Hawley on May 16, 1911 for "Electric Heater"

Unfortunately none of the prior art devices singly or even in combination provide all of the features and objectives established by the inventor for this system as enumerated below.

OBJECTIVES

1. It is an objective of this invention to provide method, devices and system for preventing rust on baseboard heaters in bathrooms near toilets.
2. Another objective of this invention is to provide a cover of non-rust high conductivity material such as aluminum to adorn all types of baseboard heaters near toilets.
3. Another objective of this invention is that it be long lasting made from durable material.
4. Another objective of this invention is that it is easy to use, install, de-install and transport.
5. Another objective of this invention is that its use be intuitive that requires little additional training.
6. Another objective of this invention is that it be environmentally friends, aesthetic and physically safe in normal environment as well as accidental situations.
7. Another objective of this invention is that it hide existing rust on baseboard heaters.
8. Another objective of this invention is that it meet all federal, state, local and other private standards, guidelines and recommendations with respect to safety, environment, quality and energy consumption.
9. Another objective of this invention is that it be suitable for all types of baseboard heaters including electric, hot water, gas etc.
10. Another objective of this invention is that it be made of modular parts and units easily interface-able to each other.
11. Another objective of this invention is that the splash guard radiator cover of this invention be suitable as an accessory for OEM.
12. Another objective of this invention is that the splash guard radiator cover of this invention be easily relocateable to any other baseboard heaters in the same complex or different complex many miles away.
13. Another objective of this invention is that the splash guard radiator cover of this invention be suitable for covering other baseboard heaters for uniform new look.
14. Another objective of this invention is that it be suitable for gift giving.
15. Another objective of this invention is that it be suitable for promotional give aways complete with message of the sponsor such as aluminum companies.
16. Another objective of this invention is that the splash guard radiator cover of this invention be of high quality with high aesthetic eye appeal.
17. Another objective of this invention is that the splash guard radiator cover of this invention have a negligible foot print and not intrude upon the space around the baseboard heater.
18. Another objective of this invention is that the splash guard radiator cover of this invention fit a variety of sizes in length, height and width etc.
19. Another objective of this invention is that the cover not be a tight fit over the baseboard heater so as to impede the flow of heat.
20. Another objective of this invention is that a heat reflector be used to smoothly redirect the flow of heat.

21. Another objective of this invention is that it includes magnets for "Easy On Easy Off" operation.
22. Another objective of this invention is that splash guard radiator cover of this invention be strong, stable, secure and long lasting.
23. Another objective of this invention is that it permit free flow of hot air through conduction, convection as well as radiation.
24. Another objective of the splash guard radiator cover of this invention is that it can be made in a variety of colors to suite the aesthetic environment and Decor.
25. Another objective of this invention is to provide a means for customizing the sizes for each particular radiator size, color and other properties.
26. Another objective of the splash guard radiator cover of this invention is to provide a means for covering the sharp edges of said cover.
27. Another objective of this invention is to provide a JOINDER MEMBER for joining two standard lengths radiator cover into a double length radiator cover.
28. Another objective of this invention is that the end interface and joinder member interface be made of flexible material so as to conform to the contours of the radiator cover ends.
29. Another objective of the splash guard radiator cover of this invention is to provide inside and outside right angle (90 degrees) connecting members.
30. Other objectives of this invention reside in its simplicity, elegance of design, ease of manufacture, service and use and even aesthetics as will become apparent from the following brief description of the drawings and concomitant description.

BRIEF DESCRIPTION OF THE DRAWINGS a). FIG. 1(*a*) is a rearward exploded perspective view of the splash guard radiator cover of this invention complete with single piece main panel 100 over baseboard heater 99 of prior art shown in dotted lines, side panels 200, with vents 210 and channel 250.

b) FIG. 1(*b*) is a magnification of magnet support member in circle marked 1(*b*) in FIG. 1(*a*)

c) FIG. 2(*a*) shows side view of the splash guard radiator cover of this invention as mounted over a prior art baseboard heater 99 d) FIG. 2(*b*) is a top plan view of the splash guard radiator cover of this invention which shows plurality of vents 260 in channel 250 of main panel 100.

e) FIG. 3 is an alternate embodiment showing rearward exploded perspective view of the splash guard radiator cover of this invention complete with an main panel 100, vertically adjustable addendum panel 101 over baseboard heater 99 of prior art shown in dotted lines, side panels 200, with vents 210 and channel 250 on main panel 100 as well as reflector 300.

f) FIG. 4 shows how multiple units are interconnected with interface 150 and end interface 190 g) FIG. 5(*a*) shows an inside corner 350 and an outside corner 360.

h) FIG. 5(*b*) shows an exploded view of an inside corner 350 and an outside corner 360.

i) FIG. 6(*a*) shows an alternate design outside view for the end panel somewhat overlapping the main panel such that its effective length can be adjusted.

j) FIG. 6(*b*) shows an exploded inside view for the end panel of FIG. 6(*a*)

k) FIG. 7(*a*) shows an isometric perspective view of the interface member between two adjacent front panels.

l) FIG. 7(*b*) shows an alternate design of FIG. 7(*a*)

m) FIG. 7(*c*) shows an enlarged view of the matching channel circled in FIG. 7(*b*)

n) FIG. 8(*a*) shows an inside view of front panel member including matching velcro (R) and matching concave-convex channel.

o) FIG. 8(*b*) shows an enlarged view of matching channel circled in FIG. 8(*a*).

DETAILED DESCRIPTION OF THE PREFERRED EMBODIMENT

Figures 1A, 1B:
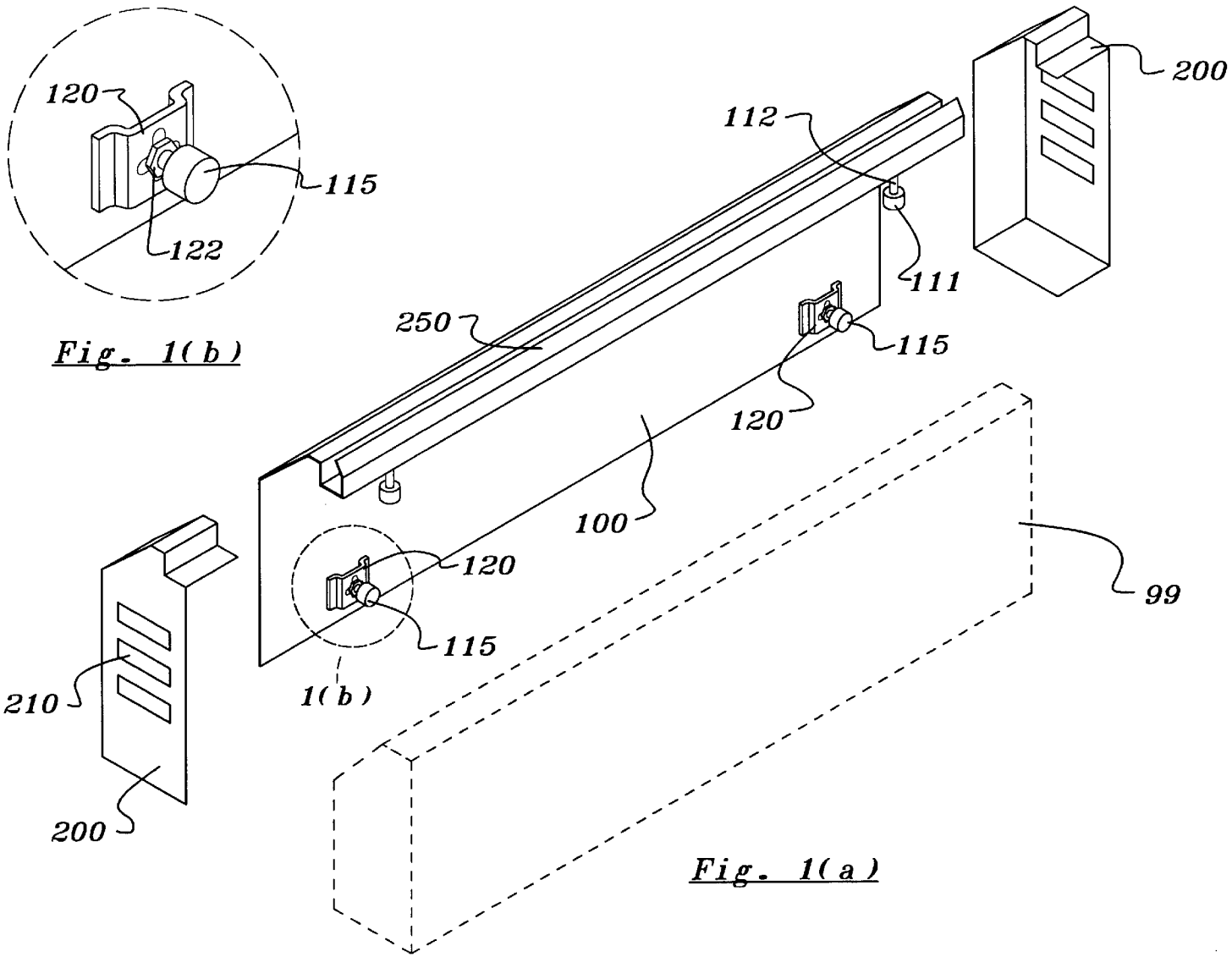

The compact, convenient splash guard radiator cover of this invention 100 as shown in the drawings wherein like numerals represent like parts throughout the several views, there is generally disclosed in FIG. 1(*a*) a rearward exploded perspective view of the splash guard radiator cover of this invention complete with single piece main panel 100 over baseboard heater 99 of prior art shown in dotted lines, side panels 200, with plurality of vents 210 and channel 250. The applicants preferred embodiment is an integrated embodiment complete with hot air vents and reflector and deflector members built as one piece.

FIG. 1(*a*) also shows plurality of upper magnets 111 secured onto bottom of channel 250 on panel member 100 via via matching plurality of studs 112. Plurality of adjustable magnets 115 are also mounted via support members 120 which includes PLUS shaped vertical and horizontal slots for adjustment of the magnet along horizontal X axis as well as vertical Y axis. FIG. 1(*b*) is a magnification of magnet support member in circle marked 1(*b*) in FIG. 1(*a*)

Figure 2A:
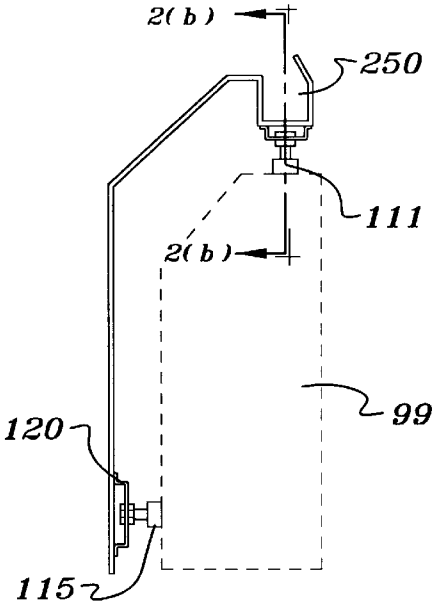
Figure 2B:
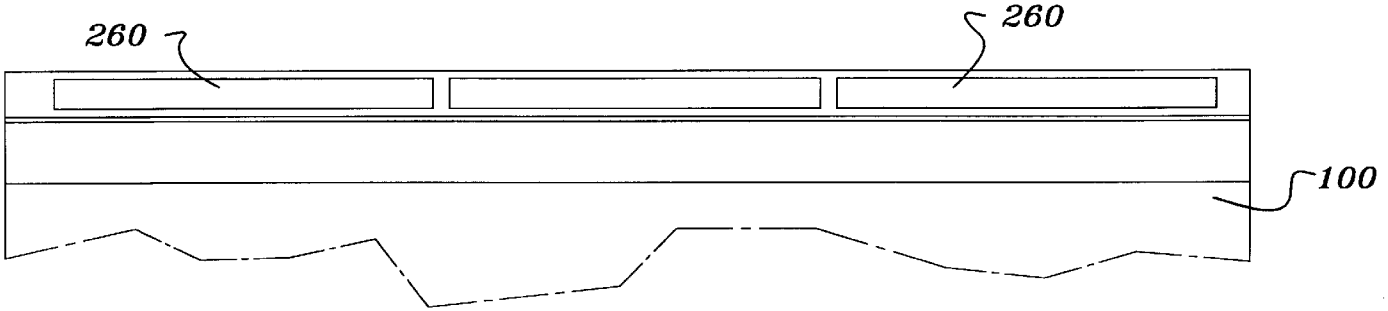

FIG. 2(*a*) shows side view of the splash guard radiator cover of this invention as mounted over a prior art baseboard heater 99 shown in dotted lines. Similarly FIG. 2(*b*) is a top plan view of the splash guard radiator cover of this invention which shows plurality of vents 260 in channel 250 of main panel 100.

Figure 3:
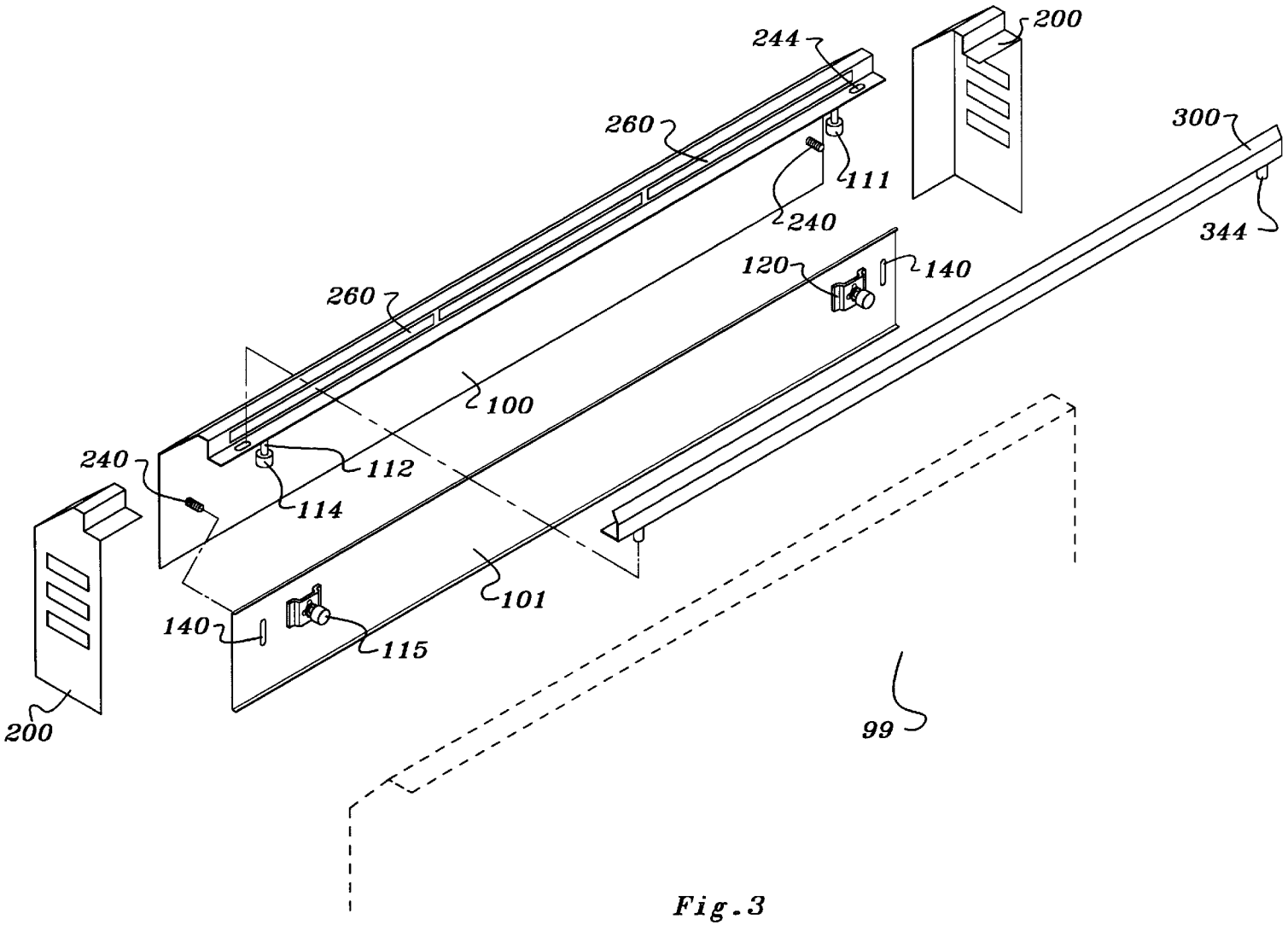

FIG. 3 is an alternate embodiment showing rearward exploded perspective view of the splash guard radiator cover of this invention complete with an main panel 100, vertically adjustable addendum panel 101 over baseboard heater 99 of prior art shown in dotted lines, side panels 200, with vents 210 and channel 250 on main panel 100 as well as reflector 300.

Figure 4:
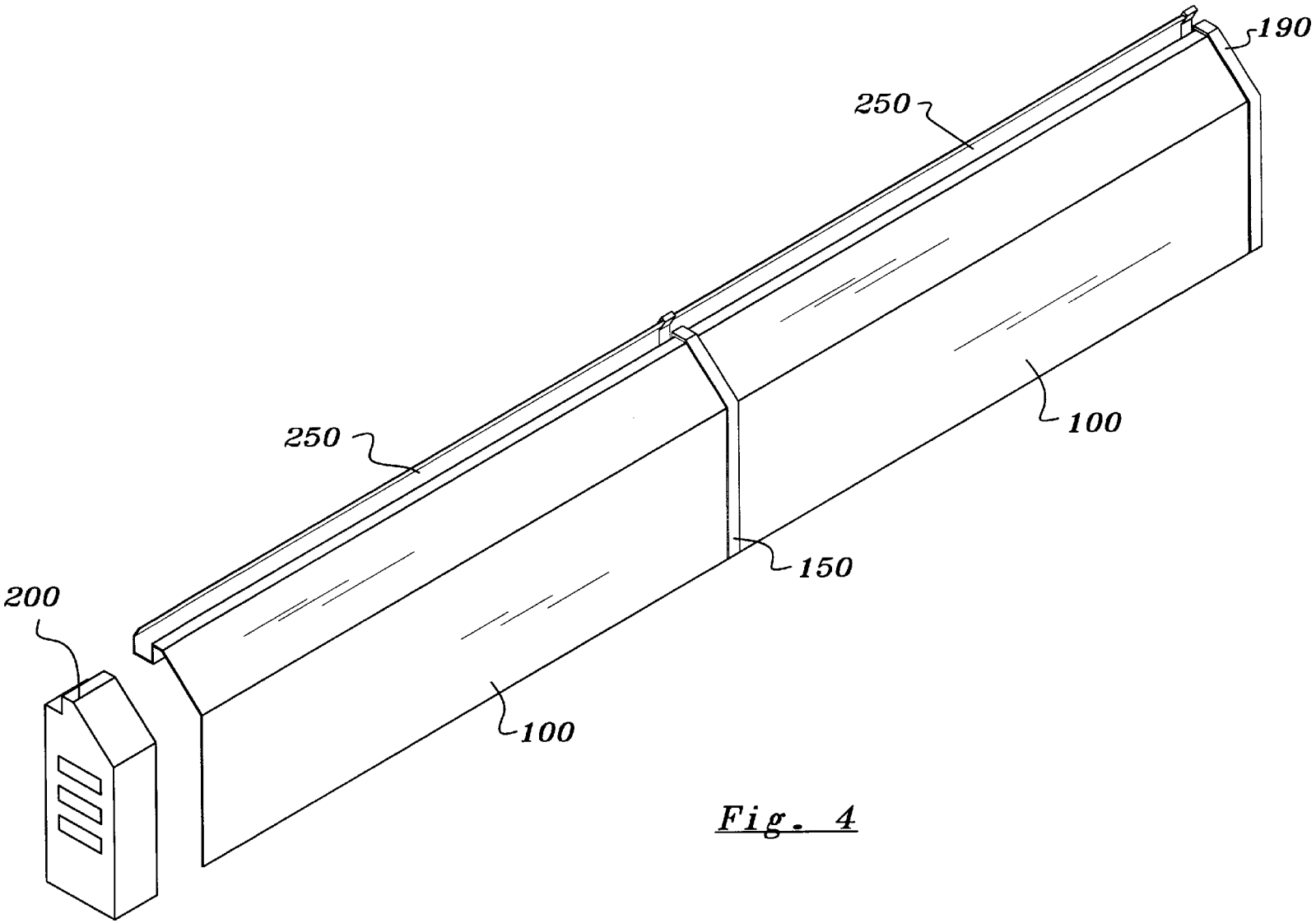
Figure 5B:
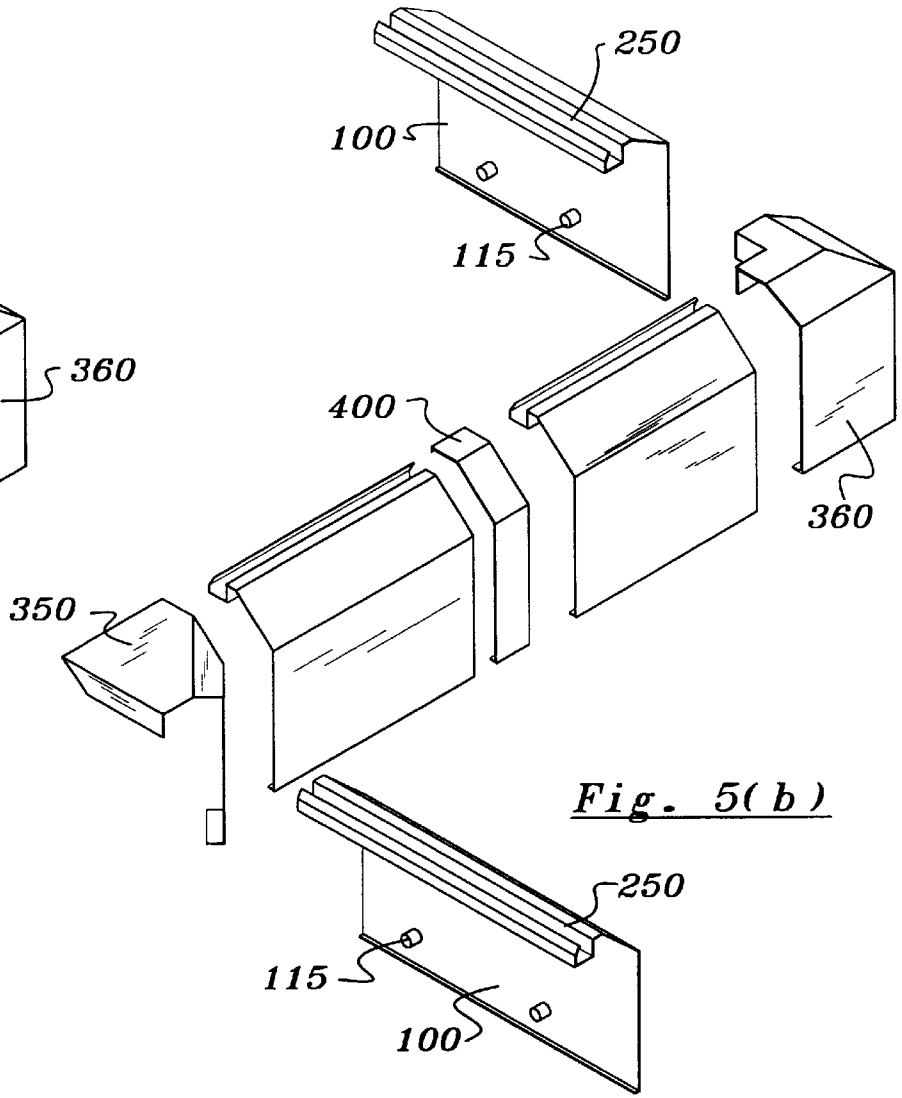
Figure 5A:
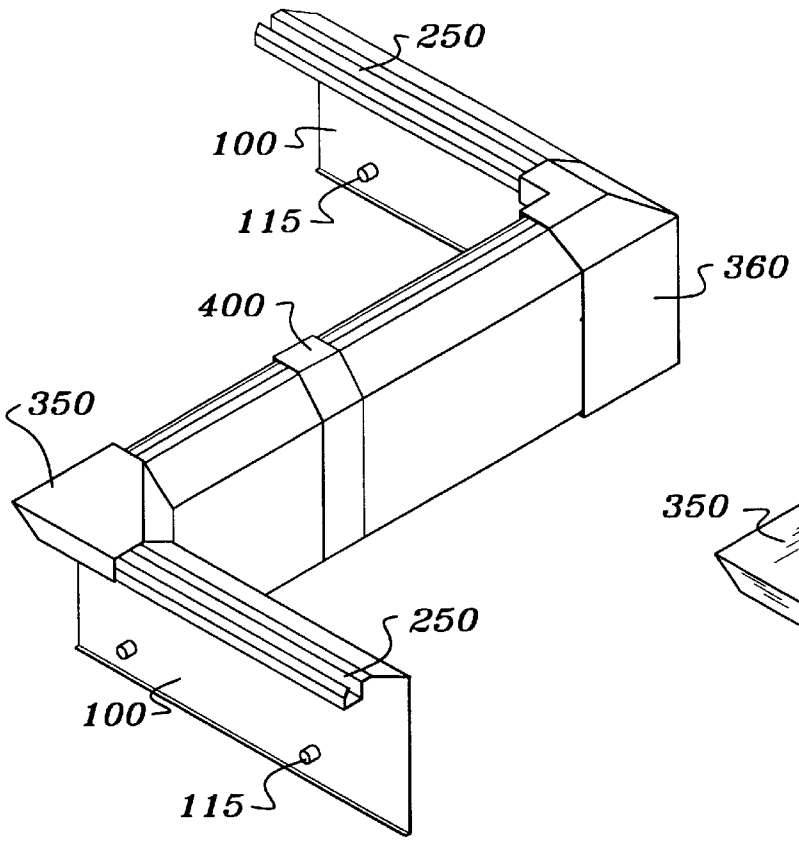
Figure 6A:
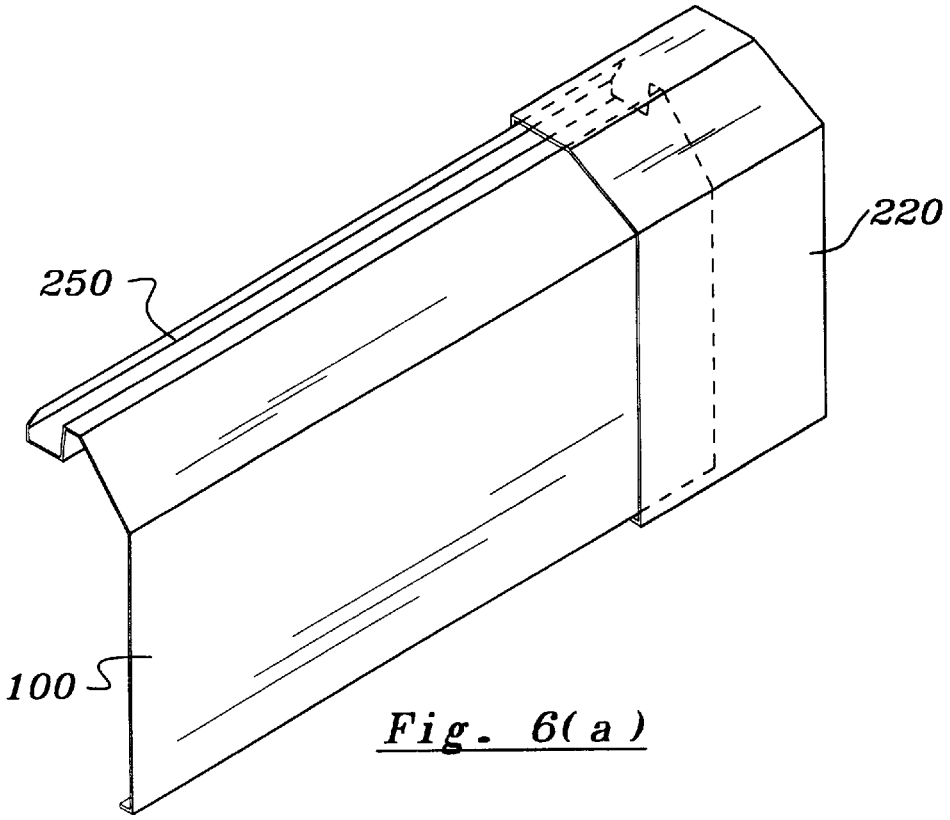
Figure 6B:
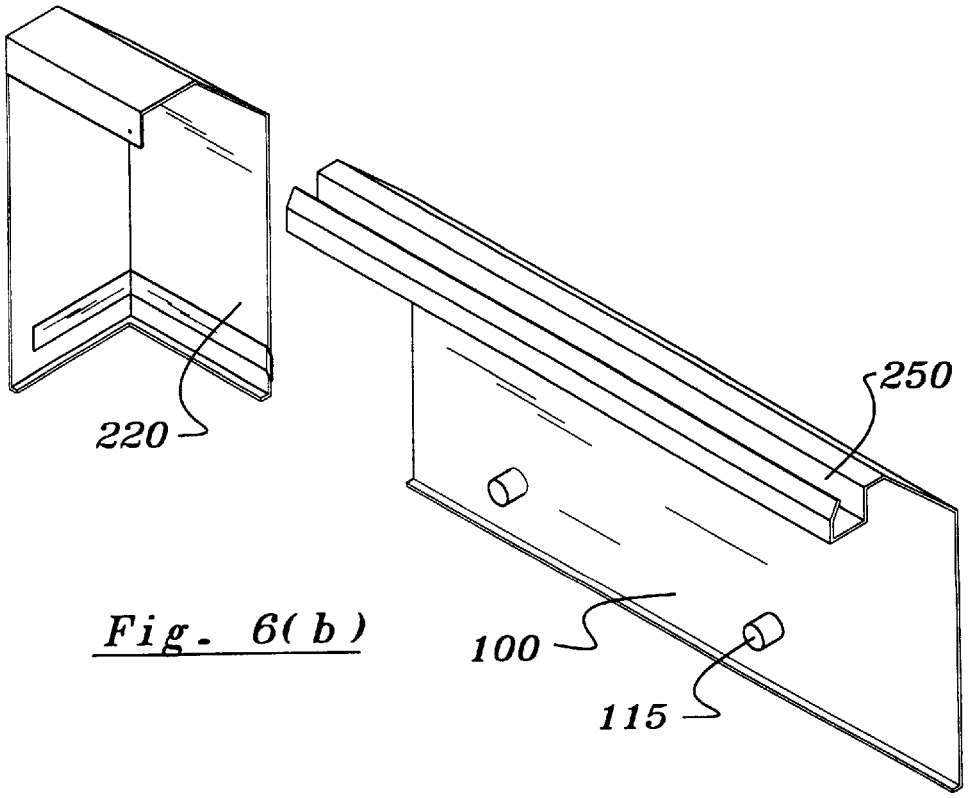
Figure 7A:
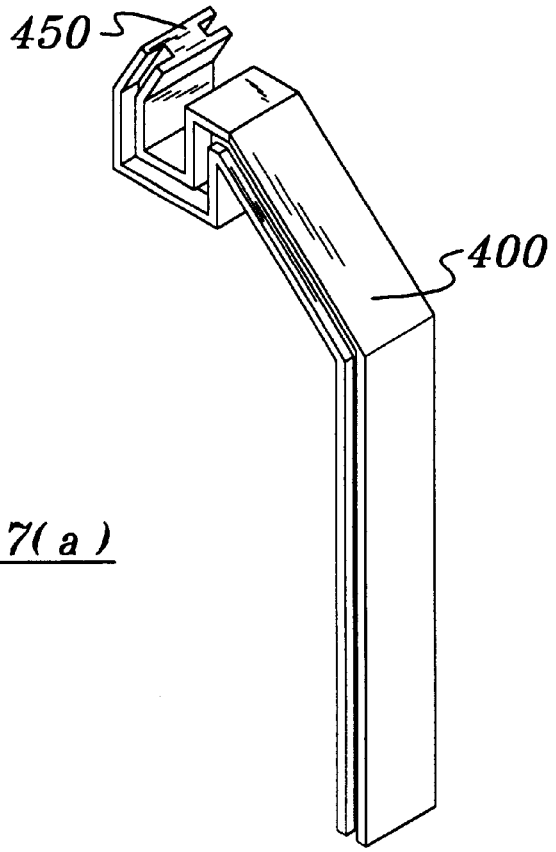
Figure 7B:
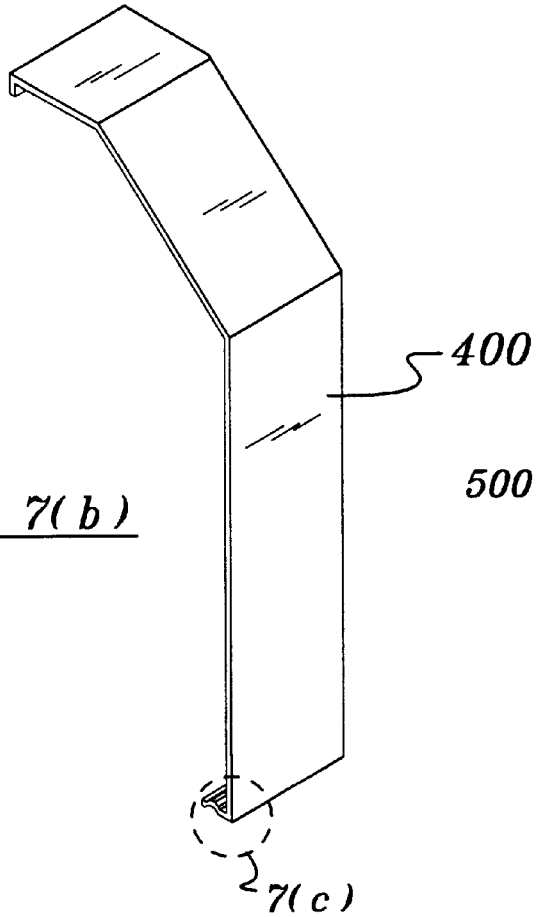
Figure 7C:
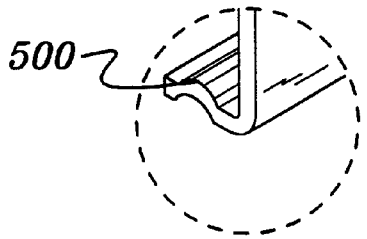
Figures 8A, 8B:
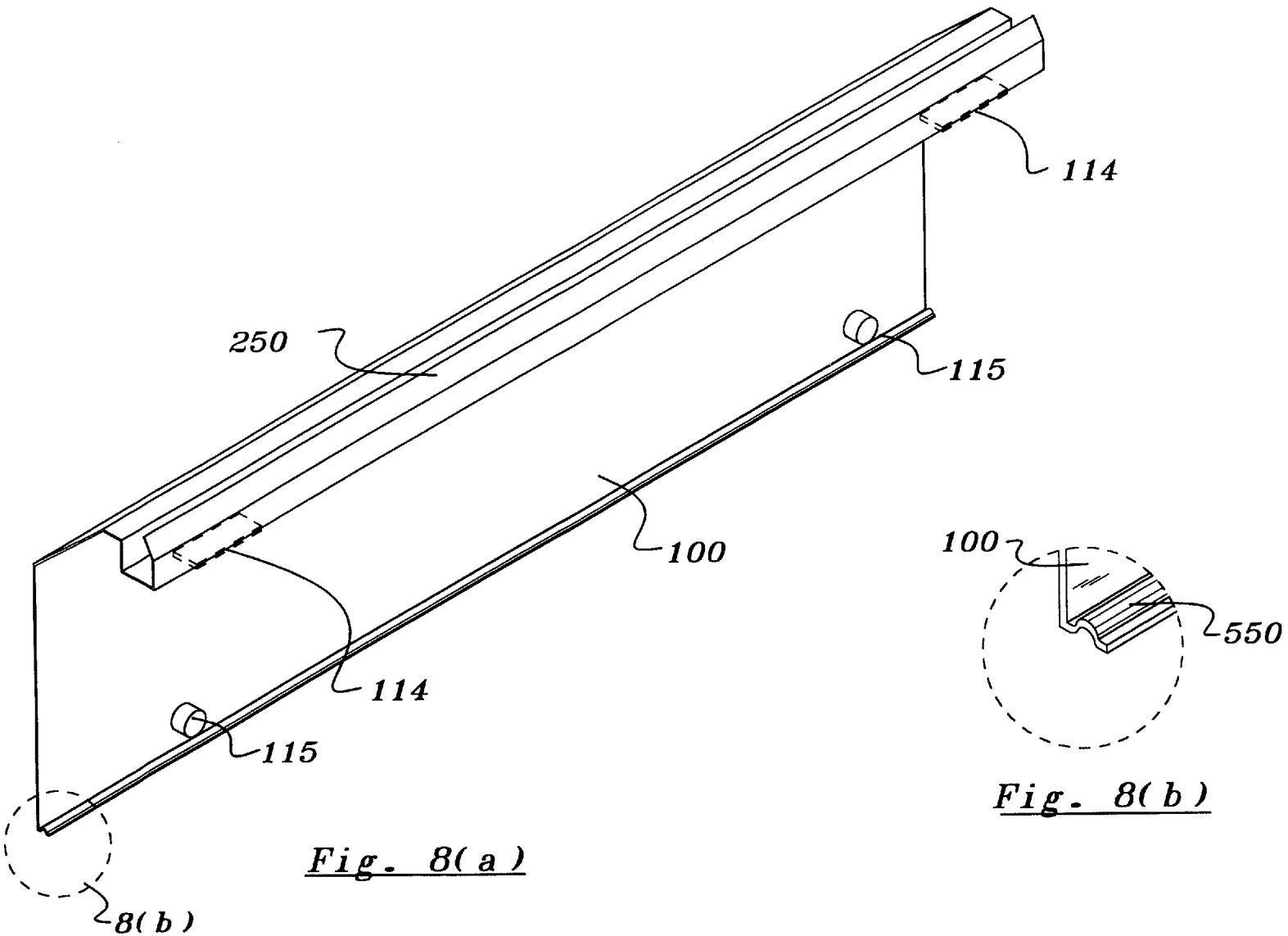

FIG. 4 shows how multiple units are interconnected with interface 150 and end interface 190.

One way to make it would be to have several different types of Bending tools. A prototype with a break used by aluminum and vinyl siders performed satisfactorily.

The break was used to bend aluminum to make aluminum casings to cover wood casings around door frames, windows, rake boards, facia boards and several other types of bending for different reasons. The inventor applicant thinks this would be a very slow process and not very practical.

Another way they could be made is with a machine similar to the ones used by gutter contractors. The aluminum is fed into the machine where it is shaped like a gutter on a house to catch the water off the roof. A machine could be made to accomplish this same method, only it would come out in the shape of a Splash Guard radiator cover.

It can also be fabricated by a sheet metal shop in great quantities. It can be made with adjustable sliding parts to fit different size heights and widths to make it universal.

The cover can be made in assorted lengths or it can be made universal to fit most baseboard radiators on the market or in existence. The modular units 100 may be interconnected with dual channel interface 150. Similarly single channel end molding 190 may be applied to the ends of the radiator cover It is better than the existing steel cover that comes with the heating baseboard because it does not rust when urine or some other acidic liquids come in contact with it. It will protect a new baseboard so that it will not rust and become unattractive. It also can be used over baseboards that have already rusted and have become unattractive.

It can also be used on other baseboard heat throughout the house or building if someone wanted to make them look new. It can be made in the different colors that baseboards normally come in. Aluminum is also a good conductor or heat and that is why on both hot water and electric baseboard the fins are made of aluminum.

It can be removed easily to wash and replace. It can be applied to the existing baseboard, by just about anyone, and without the use of any tools. It can be decaled or painted for decorative purposes.

To preserve optimum conduction and radiation of heat the radiator cover of this invention is painted only on the outside and not inside. Heat comes out from top and sides. For this reason end panels 20 have a plurality of slots 210. Vertical slots 140 are used to adjust the vertical height.

OPERATION

The cover is designed as to avoid significant heat loss when the heat is turned on. The cool air which is lowest to the floor, can still travel under the radiator (which is usually 1½" to 2½" off the floor up) through the heated fins and out the opening at the top. The cover is not a tight fit to the radiator so as to allow air to flow very freely out the top and also laterally and out the side panels 200 through plurality of vents 210 of the cover. The use and operation of this device by a consumer is simple and even intuitive.

Multiple modular units 100 are interconnected with dual channel interface 150. Similarly a single channel interface 190 may be applied to the ends of the radiator cover instead of the end panel member 200.

The user just takes the Splash Guard and sets it over your existing baseboard heat, whether the baseboard heat is electric or hot water. It would come in an assortment of lengths in increments of six inches starting with two feet. For extra long radiators they can be attached with an aluminum, plastic, or fiber glass connector. Included are lengths of this connector to cover all sharp edges. If necessary it could be made for special order or longer one piece application. The position of the magnets can be adjusted along horizontal X axis as well as Vertical Y axis by the PLUS shaped slots provided in the magnet 110 on support member 120.

The vertical height is similarly adjusted by adjusting the overlap between panels 100 and 101 via studs 240 and vertical slots 140. The orientation and angle of the deflector and reflector 300 can also be adjusted via studs 344 and slots 244

The cover is removed by simply lifting it off, so as to make cleaning of the existing radiator and washing of the new cover extremely easy. The new aluminum cover is also a good conductor of heat. There is no assembly required. The cover can be manufactured in traditional radiator color. For ease of use interface panels 200 are spring loaded, clip-on or the like arrangement. A magnet may held on a stud on the inside of the radiator cover and is not visible from the outside to distract from the aesthetics.

In the event baseboard radiator spans or negotiates around an inside or outside corner (right angle of 90 degrees) a connecting member is used to connect two sections of radiator cover at right angle (or perpendicular) to each other.

The inventor has given a non-limiting description of the concept. The simplicity and the elegance of the design of this invention makes it difficult to design around it. Nonetheless many changes may be made to this design without deviating from the spirit of this invention. Examples of such contemplated variations include the following:

1. The shape, size and materials of the various members and components may be modified.
2. A different material may be used.
3. The color, aesthetics and materials may be enhanced or varied.
4. Additional complimentary and complementary functions and features may be added.
5. A more economical version of the device may be adapted with an informational or advertising message for promotional give aways.
6. A different type of "Easy On Easy Off" may be used instead of magnets taught by this inventor.
7. A machine could be made to custom manufacture and accomplish this same method, only it would come out in the shape of a Splash Guard radiator cover.
8. A different joining member or end piece may be employed.
9. The right angle connecting member for inside and/or outside right angle (90 degrees) may be modified in angle or method.

Other changes such as aesthetics and substitution of newer materials as they become available, which substantially perform the same function in substantially the same manner with substantially the same result without deviating from the spirit of the invention may be made.

Following is a listing of the components uses in this embodiment arranged in ascending order of the reference numerals for ready reference of the reader.

099=Baseboard heater of the prior art in bathroom near a toilet.

100=Single piece integrated main panel of the splash guard radiator cover of this invention.

101=Adjustable extension of panel 100

110=Plurality of magnets or equivalent quick fastening and removal means generally

111=Stud mounted magnets

112=Studs for mounting magnets 111

114=Matching eye and hook fastener

115=Adjustable mount magnets.

120=Magnet Support member

122=PLUS shaped vertical and horizontal slots in magnet support member 120

140=Vertical slots on adjustable panel 101

150=Dual channel modular panel aesthetic interface

190=Single channel safe and aesthetic end interface

200=Side panels

210=Plurality of vents in side panels

220=Alternate embodiment for side/end panel.

240=Studs on main panel 100

244=Horizontal slots on channel 250 for adjusting orientation of reflector/deflector 300

250=Channel on main panel 100

260=Plurality of vents in channel 250 of main panel member 100

300=Deflector and reflector

344=Studs on deflector and reflector

350=Inside corner

360=Outside corner

400=A simple design for panel interface interconnecting member which overlaps two directly touching front panel members.

450=An alternate design for panel interface interconnecting member including dual channel interface which overlaps two non-touching front panel members except through the interconnecting member.

500=Matching guiding channel on interface interconnecting member.

550=Matching guiding channel on inside of front panel member.

DEFINITIONS AND ACRONYMS

A great care has been taken to use words with their conventional dictionary definitions. Following definitions are included here for clarification.

3D=Three Dimensional

DIY=Do It Yourself

Integrated=Combination of two entities to act like one

Interface=Junction between two dissimilar entities

Isometric=Drawings with equality of measure with the prototype of the inventor

OEM=Original Equipment Manufacturer

Symmetrical=The shape of an object of integrated entity which can be divided into two along some axis through the object or the integrated entity such that the two halves form mirror image of each other.

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefor contemplated that the appended claim(s) cover any such modifications, embodiments as fall within the true scope of this invention.

What is claimed is:

1. A splash guard cover for baseboard radiator covers comprising:

a) at lease one horizontally and vertically adjustable panel member having a plurality of openings;

b) a reflector member connected to said panel member;

c) vertically and horizontally adjustable magnet means for attaching said panel member over a baseboard radiator; and d) a pair of flexible end panel members each having a plurality of ventilation slots connected to each end of said panel member.

2. The splash guard cover for baseboard radiator covers of claim 1 wherein at least one of said panel members negotiates a right angled turn to fit over an L shaped radiator cover of the prior art.

3. The splash guard cover for baseboard radiator covers of claim 2 wherein said plurality of adjustable interconnecting and overlapping panel members are interconnected by a dual channel flexible molding material.

4. The splash guard cover for baseboard radiator covers of claim 2 wherein:

a) said plurality of adjustable interconnecting and overlapping panel members are interconnected by a an overlapping interface member;

b) said plurality of panels comprise an upper panel and a lower panel touching each other; and c) said seamless attribute is achieved by positioning above said upper panel and said lower panel an overlapping interconnecting member.

5. The splash guard cover for baseboard radiator covers of claim 4 wherein said adjustable panel members and said overlapping interface member include a concave/convex matching channels.

6. An adjustable splash guard cover for baseboard radiator covers comprising:

a) a plurality of interconnecting overlapping panel members interconnected by a dual channel flexible molding material each having a plurality of ventilation slots and wherein combination is adjustable vertically as well as horizontally;

b) at least one adjustable reflector member along the entire length of said plurality of interconnecting overlapping panel members and connected to said overlapping panel members; and c) means for attaching said panel member over a baseboard radiator; and d) a pair of flexible end panel members each having a plurality of ventilation slots connected to each end of said panel member.

7. The adjustable splash guard cover for baseboard radiator covers of claim 6 wherein means for attaching said panel member comprises overlapping and matching "Eye & Hook" adjustable fastener means.

8. The adjustable splash guard cover for baseboard radiator covers of claim 6 wherein at least one of said panel members negotiates a right angled turn to fit over an L shaped radiator cover of the prior art.

9. The adjustable splash guard cover for baseboard radiator covers of claim 6, wherein said overlapping panel members are sliding seamless panel members.

10. The adjustable splash guard cover for baseboard radiator covers of claim 9, wherein said plurality of panels comprise an upper panel and a lower panel and wherein said seamless attribute is achieved by positioning upper panel over said lower panel.

* * * * *